United States Patent [19]

Tucker et al.

[11] 3,937,333

[45] Feb. 10, 1976

[54] APPARATUS FOR LAYING DOWN STRUCTURAL MEMBERS

[75] Inventors: Roy G. Tucker, Whitman; Ernest G. Fruzzetti, North Abington; Charles R. Ribak, Stoughton; Russell C. Bricknell, South Braintree, all of Mass.

[73] Assignee: General Dynamics Corporation, St. Louis, Mo.

[22] Filed: Sept. 9, 1974

[21] Appl. No.: 504,049

[52] U.S. Cl. ..... 214/1 Q; 72/250; 198/103; 198/237; 214/91 R

[51] Int. Cl.[2] ..... B21B 39/30

[58] Field of Search ..... 214/1 Q, 1 QG, 91 R; 198/103, 237; 72/250, 251, 426, 427

[56] References Cited

UNITED STATES PATENTS 2,865,516 12/1958 Hedderich ..... 214/1 Q

FOREIGN PATENTS OR APPLICATIONS 423 1/1965 Japan ..... 72/250

953,871 12/1956 Germany ..... 72/250

*Primary Examiner*—Robert J. Spar
*Assistant Examiner*—George F. Abraham
*Attorney, Agent, or Firm*—Fitch, Even, Tabin & Luedeka

[57] ABSTRACT

Apparatus is described for laying down structural members having cross sections of substantial depth, such as T-beams. Means are provided defining at least one recess into which the member is received in an upright position. An outgoing conveyor is provided for moving the member in a direction away from the recess defining means. The recess defining means is rotated about a substantially horizontal axis which lies in a plane normal to the direction of movement of the outgoing conveyor to move a portion of the member which projects from the recess into engagement with the conveyor to be moved out of the recess.

6 Claims, 9 Drawing Figures

APPARATUS FOR LAYING DOWN STRUCTURAL MEMBERS

This invention relates generally to materials handling apparatus and, more particularly, to apparatus for laying down structural members having substantially elongated cross sections. The invention is particularly suited to use with large beams, such as T-beams.

Certain shapes of large structural members may be exceedingly difficult to handle. This is particularly true in the case of large structural members which have deep or substantially elongated cross sections. Such structures when standing up have a tendency to topple, creating a dangerous condition for both machinery and personnel.

For example, T-beams are commonly produced by automated fabricators from which they emerge in an upright inverted position. In other words, the beam emerges with its flange downwardly and with its web substantially vertical extending upwardly from the flange. These beams are typically moved away from the fabricator in the logitudinal direction on a conveyor upon which the flange rests. Once clear of the welding sequence of the fabricator, however, these large shapes have a tendency to topple due to the large web height and small flange width. Falling of these shapes onto adjacent apparatus would cause serious damage, since such T-beams may weigh up to four tons each. Moreover, a toppling T-beam can cause serious damage to the building in which the T-beam fabricator is housed and may endanger personnel in the area. It is therefore desirable that the beam be laid down or tipped over onto its side in a generally horizontal position on the outgoing conveyors. The beams are removed from the outgoing conveyors by a magnetic crane using the web of the beam for magnetic pickup.

One common method for laying down the T-beams in the situation described above is by using an overhead crane fitted with a spreader bar and with rolling plate grabs. Upon exit of the beam from the T-beam fabricator, the rolling plate grabs are attached to the upper edge of the web as it proceeds out of the machine moving along the spreader bar. When the shape is completely clear of the T-beam fabricator, the crane takes a lift on the shape moving transversely and laying the shape on its side on the outgoing conveyors. The plate grabs are then released from the web by hand to allow the crane to resume its original position for handling the next shape emerging from the fabricator.

The foregoing described lay down technique has a number of disadvantages. The use of a crane almost exclusively for the servicing of the machine adds substantially to the capital investment. Moreover, as the beam emerges from the fabricator, the plate grabs have to be attached to the top of the web by hand. Typically, this requires the full time attention of two riggers, one operating the crane and the other attaching the plate grabs and releasing the plate grabs after the shape is laid down on the outgoing conveyors. This results in a substantial operating cost due to the cost of the personnel. Additional capital cost may be required for the construction of walkways to allow access by the riggers to the webs of the T-beams as the beams emerge from the fabricator. Finally, the time involved in attaching and releasing rig plate grabs on the beam, and moving the crane to lay down the shape and returning the crane to its original position, requires a consequent increase in labor hours.

It is an object of the present invention to provide improved apparatus for laying down structural members having deep cross sections.

It is another object of the invention to provide apparatus for efficiently and safely handling T-beams emerging from a fabricator.

It is another object of the invention to provide apparatus for laying down structural members of deep cross sections which is entirely automated and does not require manual attachment and release of elements to the shapes being handled.

Other objects of the invention will become apparent to those skilled in the art from the following description, taken in connection with the accompanying drawings wherein.

Figure 1:
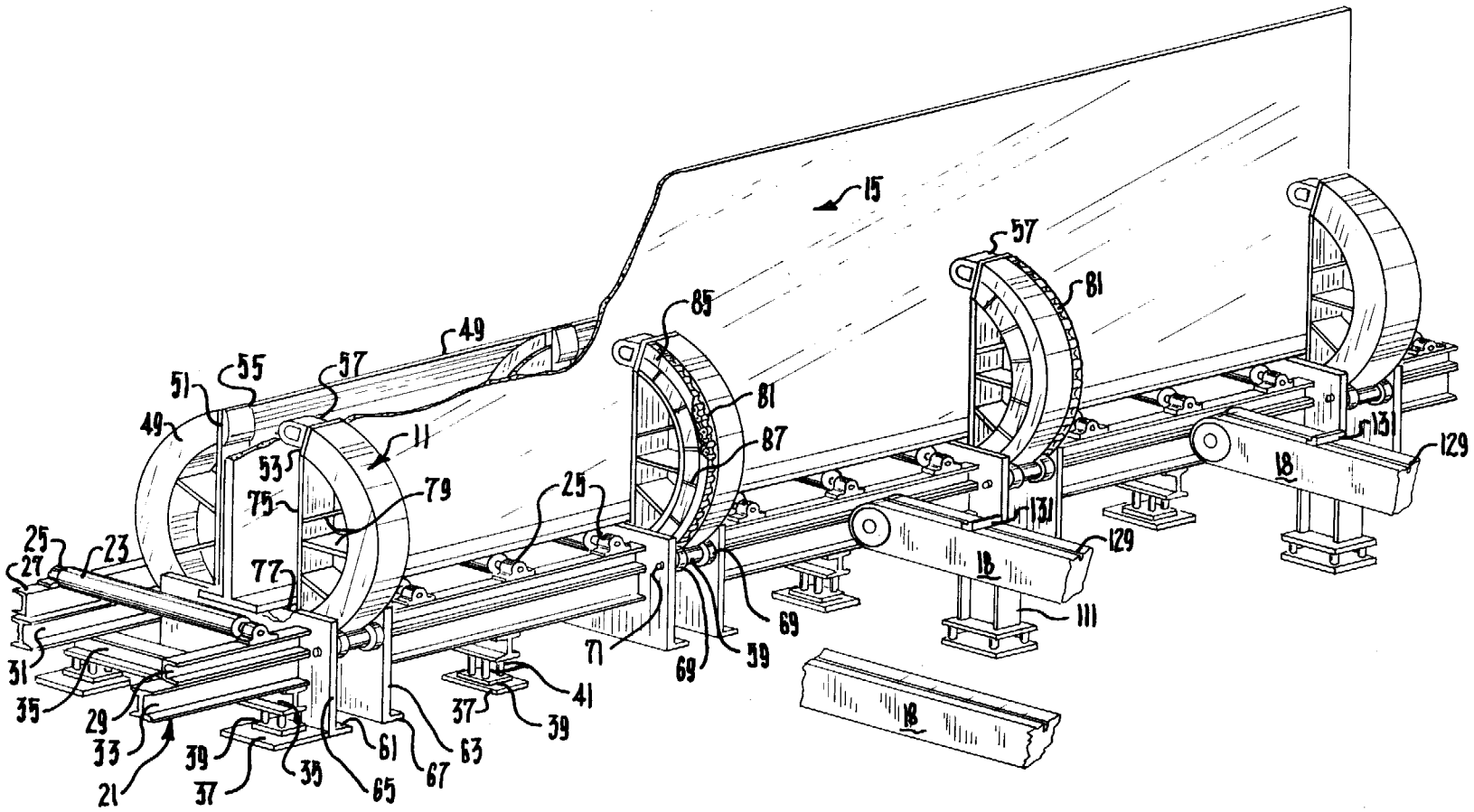
FIG. 1 is a perspective view, with parts broken away, illustrating the apparatus of the invention.
Figure 3:
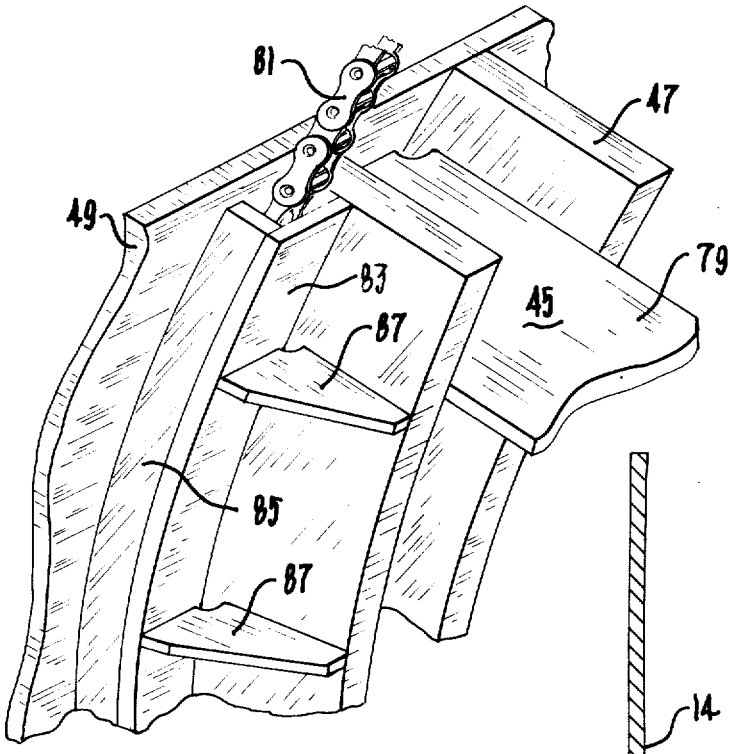
FIG. 3 is a sectional view taken along the line 3—3 of FIG. 2.

Very generally, the apparatus of the invention includes means 11 defining at least one recess 12 having an open top side 13 for receiving and supporting a member 14 in an upright position. Conveyor means 15 are provided for moving the member in a direction away from the recess defining means. Means 16 are provided for rotating the recess defining means about a substantially horizontal axis 17 which lies in a plane normal to the direction of movement of the conveyor means to move a projecting portion of the member in the recess into engagement with the conveyor means to be moved out of the recess.

Referring now more particularly to the drawings, the conveyor upon which the T-beam 15 moves is divided into segments which extend between the means 11. Each conveyor segment includes a plurality of rolls 23, each of which is supported at its opposite ends for rotation in journal blocks 25. The journal blocks 25 in each of the segments of the conveyor 21 are supported on and distributed along a pair of parallel channel beams 27 and 29. The channel beams 27 and 29 in each of the conveyor segments are mounted, respectively, on I-beams 31 and 33. The I-beams run the entire length of the apparatus of the invention and are supported on a plurality of spaced cross I-beams 35. Each of the I-beams 35 rests upon a pair of mounting pads 37 which are bolted to the floor and upon which are secured mounting plates 39. The mounting plates 39 each supports a plurality of threaded mounting posts 41 which provide for threaded adjustment of the I-beams 35 for levelling the conveyor.

For the purpose of handling the T-beams, the apparatus of the invention includes, as illustrated, four rotary supports or rings 11 aligned on a common axis (shown in FIG. 2) which is horizontal, parallel with the conveyor 21. Each of the rings has a gap 13 therein of approximately 30° and includes an outer plate 43 extending along the peripheral edges of a pair of parallel side plates 45 and 47 (see FIG. 2). The outer plate 43 terminates at approximately 200° of arc and a large plate 49 is welded to the peripheries of the plates 45 and 47 on the back side of the apparatus extending between all of the rings 11 to join them together for simultaneous movement, as will be explained below. At the gap 13, each of the rings is provided with end closure plates 51 and 53 to which are mounted rubber bumpers 55 and 57, respectively. As may be seen in the drawings, the bumper 57 is formed with an integral loop for accommodating the weight of the T-beams as will be explained.

Figure 4:
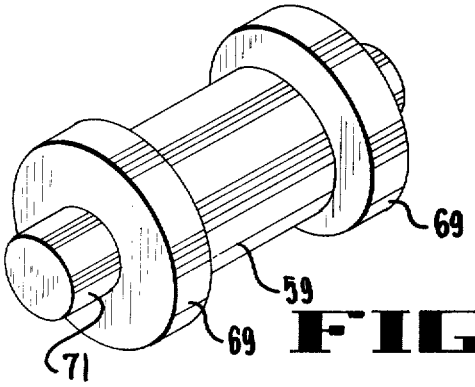
FIG. 4 is a detailed view illustrating a portion of the apparatus of FIGS. 1 and 2.

Each of the rings 11 is supported by four turning rollers 59, a detailed drawing in perspective of one of the turning rollers being shown in FIG. 4. The turning rollers 59 are supported between pairs of vertical support brackets 61 and 63. The support brackets 61 and 63 are provided with bottom flanges 65 and 67, respectively, by which they are suitably mounted to the floor. Each of the turning rollers is provided with a pair of spaced annular shoulders 69 which fit inside of the spaced parallel brackets 61 and 63. Spindles 71 extend from each end of the rollers 59 through suitable receiving openings in the brackets. Spacing of the annular shoulders 69 just exceeds the width of the plate 43 so that the rollers 59 form a track in which the rings 11 rest and in which they may be rotated about their axis 17.

Each of the rings 11 has an internal frame for defining the recess 12. The internal frame is formed by a pair of vertical plates 73 and 75 which extend parallel with each other from the terminus of the ring on each side of the opening or gap 13. At their lower ends, the plates 73 and 75 are joined by a bottom or horizontal plate 77. The rigidity of the frame is enhanced by a plurality of plates 79 which extend radially inward from the plate 43 and from the plate 49 between the respective plates 45 and 47.

Each of the two middle rings is modified to provide a chain trough for accommodating a roller drive chain 81. The trough comprises a plate 83 which extends perpendicularly of the ring plate 45 toward the outer periphery thereof, and a plate 85 which is spaced from the plate 45 and a parallel thereto extending outwardly of the plate 83 to terminate even with the outer periphery of the plate 45. The plate 49 therefore abuts the outer periphery of the plate 85 and is suitably welded thereto. In order to buttress the plate 83, a plurality of chocks 87 are distributed about the plate 45, suitably welded to the plate 45 and to the plate 83. The chain 81 is thus accommodated in the trough defined by the plates 83 and 85, underneath the plate 49.

The two center rings 11 are each provided with a chain 81 in the chain trough which serves to rotate the rings. The chain 81 on each of the rings terminates and is anchored at each end to a respective side of the gap or opening 13. Lying in the trough, the chain encompasses the ring to which it is attached and extends out of the chain trough below the conveyor rolls 23, tangent to the ring. Two idler sprockets 89 and 91 are suitably mounted to the brackets 61 and 63 below each of the middle two rings 11 to maintain the tangential relationship of the chains 81 to their respective rings. A loop of the chain then extends downwardly and passes around a drive sprocket 93, also mounted between the brackets 61 and 63. The sprocket 93 is secured to a drive shaft 95 to which a further sprocket 97 is also secured. The sprocket 97 is rotated to drive the sprocket 93 by means of a drive chain 99 extending to a drive sprocket 101. The drive sprocket 101 is driven by means of a drive shaft 103 from a double-ended gear box 105, driven by a drive motor 107. The gear box 105 is suitably mounted on a base 109 to the floor.

After the beams are laid down on the outgoing conveyor means 15, as will be described in greater detail below, they are carried by the outgoing conveyor means in a direction which is substantially normal to the longitudinal axis of the beam. The outgoing conveyor means comprises three parallel conveyors. Each conveyor has a plurality of vertical I-beam supports 111 which rest upon plates 113. The plates 113 are supported on a plurality of adjustable threaded legs 115 which extend upwardly from pods 117 bolted to the floor. The upper part of the beams 111 support a plate platform 119 which is made rigid by means of a plurality of web type flanges 121.

A frame 123 is supported on the conveyor plates 119 for supporting a plurality of driving sprockets 125. The driving sprockets 125 are driven by a motor, not shown, and operate to move a plurality of conveyor chains 127. The chains are attached to conveyor belts 129 which move generally horizontally and parallel with each other to support and move the beams as will be described. The conveyor belts 129 are provided with a plurality of lugs 131 thereon which extend outwardly for engaging the flange or T-portions of the beam as will be described.

Referring now more particularly to the operation of the device, the operation will be described with reference to the illustrated apparatus, which is adapted for handling T-beams. Other large shapes, however, could readily be handled by the illustrated apparatus, or by apparatus suitably modified and within the scope of the present invention.

Figure 2:
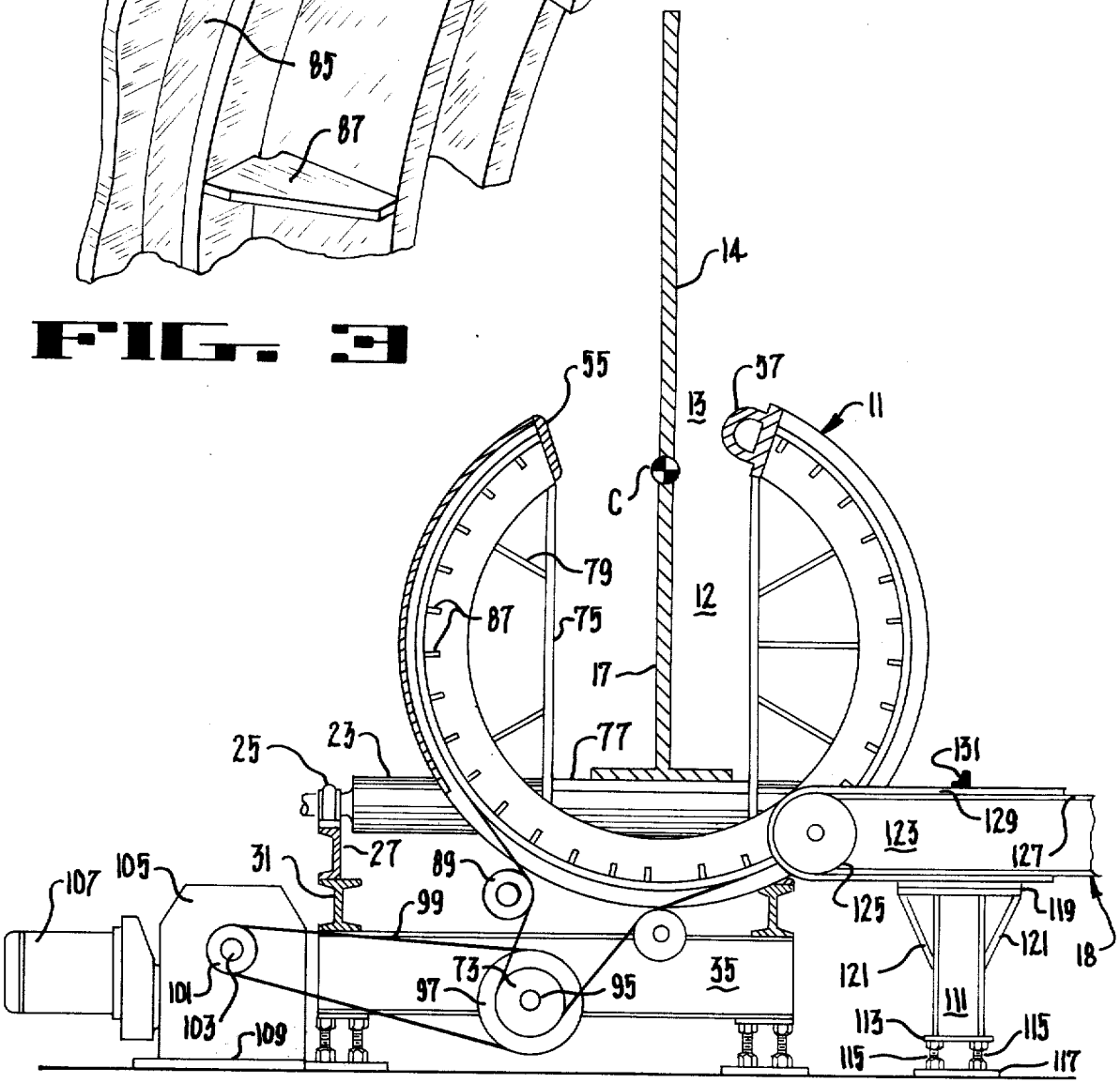
FIG. 2, is a full cross sectional view of the apparatus of FIG. 1.

As illustrated in FIGS. 1 and 2, the apparatus of the invention is positioned with the gap 13 at the top in order to receive a T-beam fabricator, not illustrated. The T-beam 15 moves out of the fabricator along the conveyor from a direction extending from the lower left of the drawing in FIG. 1 to the upper right. Once the T-beam is in the illustrated position, the conveyor is stopped by a suitable limit switch, not shown. Operation of the apparatus of the invention is then initiated by energizing the motor 107. Operation of the motor drives the two chains 99 to rotate, simultaneously, all four of the rings 11.

Figure 5:
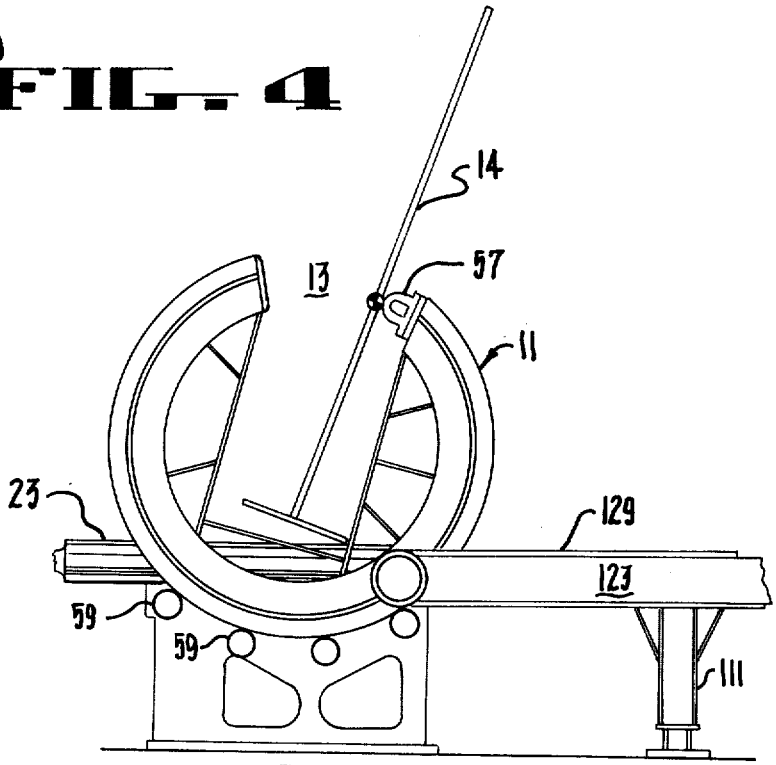
FIGS. 5 to 9 are simplified cross sectional views illustrating the sequence of operation of the apparatus of the invention.

As the rings 11 rotate to the position shown in FIG. 5, the lower plates 77 rise and engage the underside of the flange of the T-beam. As the rear edge of the flange is lifted, the shape tips and the web lies against the rubber bumper 57. This is the condition at which the center of gravity of the beam, indicated at C, moves beyond the forward edge of the flange of the T-beam.

Figure 6:
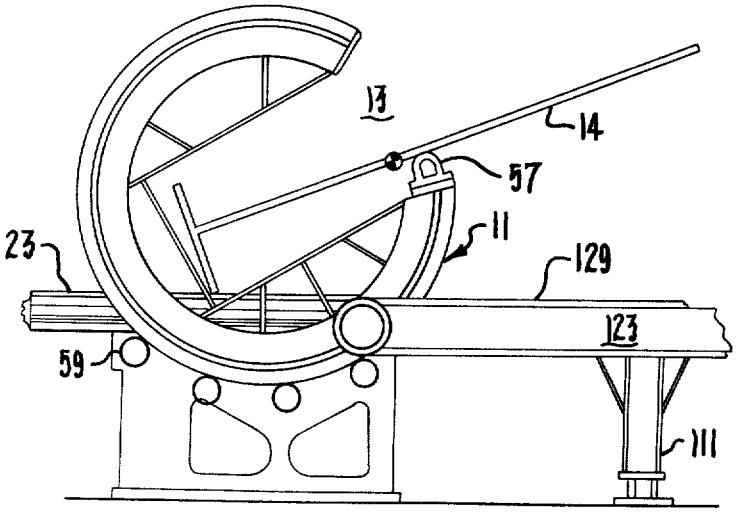
Figure 7:
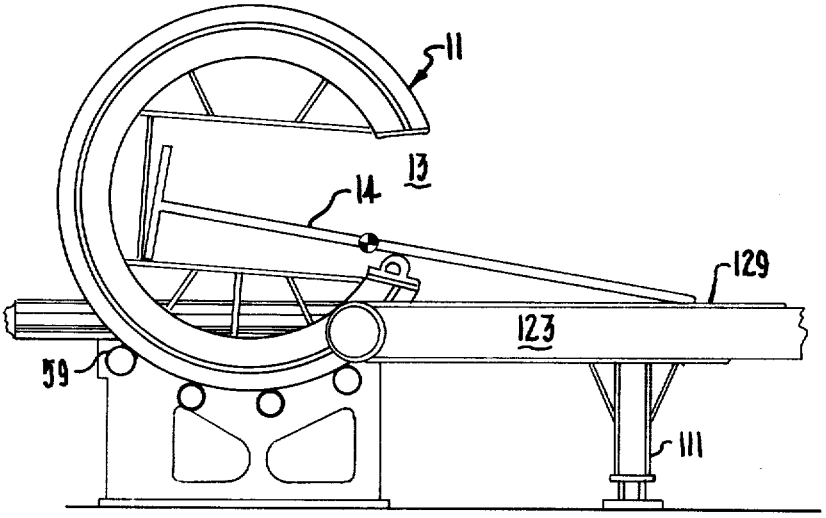
Figure 8:
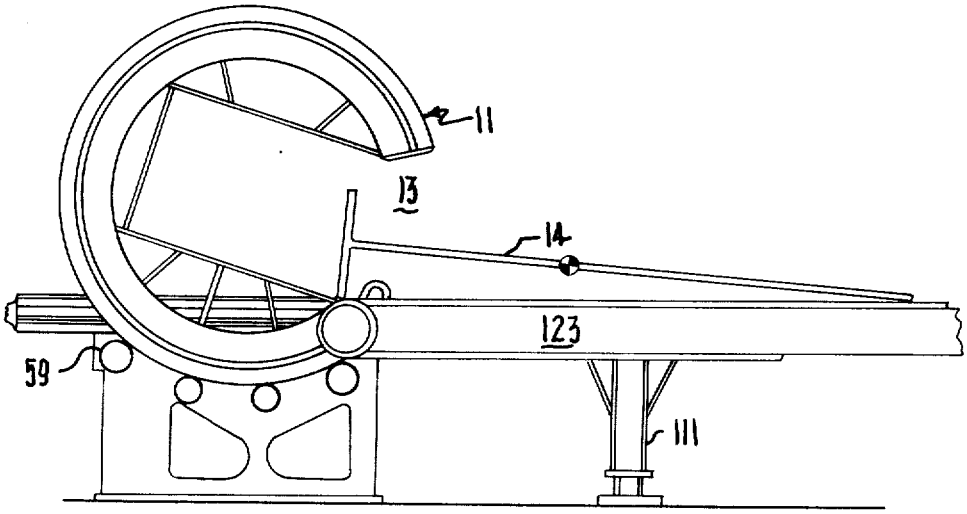
Figure 9:
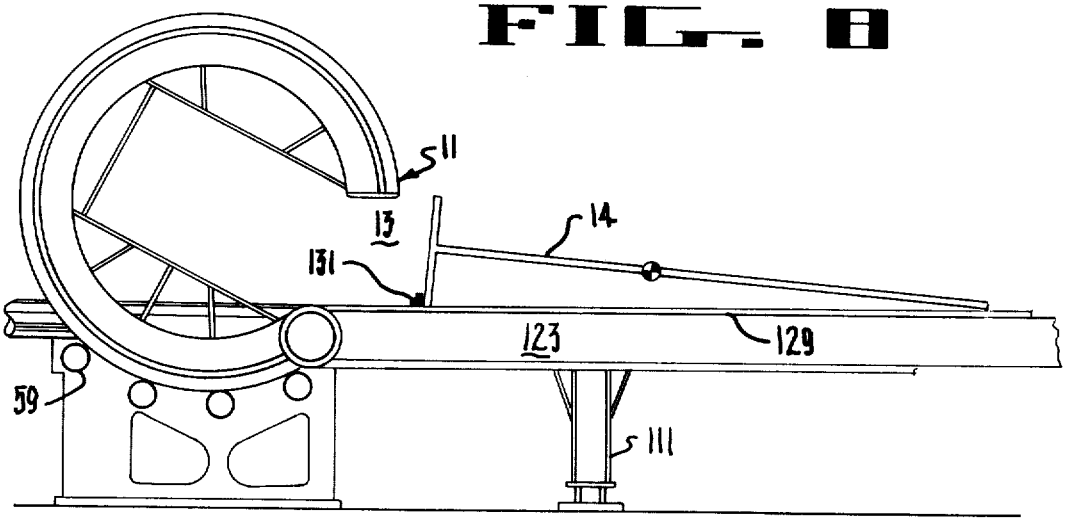

As the apparatus continues to rotate, the weight of the beam causes it to slide back until the flange bottoms on the plate 77 once again, as shown in FIG. 6. Continued rotation of the apparatus occurs until the top edge of the web contacts the transverse outgoing conveyors as shown in FIG. 7. Once this occurs, a suitable limit switch, not shown, causes the motor 107 to stop and causes the driving means, not shown, for the outgoing conveyors to begin operation. This causes movement of the outgoing conveyors and in particular movement of the belts 129, producing a drag on the end of the web of the beam by the conveyor belts. This drag is assisted by gravity as the beam slides along the inclined surface of the plate 75 until it reaches the position shown in FIG. 8. As the flange of the beam clears the opening 13, it is engaged by the dogs 131 mounted on the conveyor belts, thereby picking up the flange at the T-shape and moving the beam clear of the rings 11 as sown in FIG. 9. The beam is now in a position to be picked up by a magnetic crane, not shown. Energization of the apparatus may then be effected to cause the apparatus to return to the position shown in FIGS. 1 and 2, at which a suitable limit switch, not shown, causes deenergization of the motor. It is possible to accomplish the foregoing sequence of events in 90 seconds.

Numerous advantages accrue from the apparatus of the invention. When T-shapes or other similar large shapes emerge from the fabricator, they are immediately captured in the rings 11, assuring stability of the shape and eliminating any hazardous condition. The operation of the apparatus may be accomplished by only one man using a control panel. A suitable interlock system activated and de-activated by the foregoing described but unillustrated limit switches may prevent the danger of human error and damage to the equipment. Precise control over large shapes and improved safety is achieved by using the double-chain drive system. Thus, if one of the chains fails, the other will hold the mechanism due to the common shaft coupling through a worm gear box 105. The system is relatively easy to maintain because of access to all mechanical parts. A significant reduction in cost of construction occurs due to the simplicity of the design and the elimination of the necessity of a full-time service crane in the area. Operating costs are similarly reduced through the elimination of a crane operator and rigger.

It may therefore be seen that the invention provides an improved apparatus for handling large shapes in which the shapes are moved from an upright position to a position in which they are laid down on their sides.

Various modifications of the invention in addition to those shown and described herein will become apparent to those skilled in the art from the foregoing description and accompanying drawings. Such modifications are intended to fall within the scope of the appended claims.

What is claimed is:

1. Apparatus for laying down structural members having cross sections of substantial depth, comprising, means defining at least one recess having an open top side for receiving and supporting a member in an upright position, a first conveyor for moving the structural members into said recess, said recess being of a depth less than the depth of the member's cross section to leave a portion of the member projecting from the recess through the open top side, said recess defining means including a bottom plate and a pair of substantially parallel side plates supported spaced a fixed distance from each other, a second conveyor for moving the member in a direction away from said recess defining means substantially normal to the direction of movement of said first conveyor, and means for rotating said recess defining means about a substantially horizontal axis which lies substantially parallel with the direction of movement of said first conveyor and in a plane normal to the direction of movement of said second conveyor to move the projecting portion of the member in said recess into engagement with said conveyor to be moved out of said recess on said conveyor, said second conveyor being positioned at an elevation with respect to said recess defining means such that, after rotation of said recess defining means, the one of said side plates closest to said second conveyor is inclined with respect thereto to allow the member to slide out of said recess and onto said second conveyor.

2. Apparatus according to claim 1 wherein the depth of said recess exceeds the distance from the lower edge of said member to its center of gravity.

3. Apparatus according to claim 1 wherein said second conveyor includes a plurality of lugs for engaging the member to assist moving it out of said recess.

4. Apparatus according to claim 1 wherein said recess defining means comprise a plurality of rotary supports aligned on a common axis of rotation and spaced along said axis for accommodating structural members which are elongated.

5. Apparatus according to claim 4 wherein said rotary supports each comprise a ring having an internal frame defining said recess, each of said rings having an open segment at the mouth of said recess.

6. Apparatus according to claim 5 wherein said rotating means include a plurality of chains, each secured to a respective one of said rings at the periphery thereof, said rotating means further including a chain drive system for simultaneoutly driving said chains.

* * * * *